US007417340B2

(12) United States Patent
Alvarez et al.

(10) Patent No.: US 7,417,340 B2
(45) Date of Patent: Aug. 26, 2008

(54) POWER SUPPLY FOR MODEL VEHICLE

(75) Inventors: Joseph Alvarez, Avoca, MI (US); Richard Mosher, Memphis, MI (US)

(73) Assignee: Lionel L.L.C., Chesterfield, MI (US)

( * ) Notice: Subject to any disclaimer, the term of this patent is extended or adjusted under 35 U.S.C. 154(b) by 283 days.

(21) Appl. No.: 11/123,726

(22) Filed: May 6, 2005

(65) Prior Publication Data

US 2006/0249312 A1 Nov. 9, 2006

(51) Int. Cl.
*G01R 1/20* (2006.01)

(52) U.S. Cl. ..... 307/154

(58) Field of Classification Search ..... 307/154
See application file for complete search history.

(56) References Cited

U.S. PATENT DOCUMENTS 5,492,290 A * 2/1996 Quinn et al. ..... 246/219
6,320,346 B1 * 11/2001 Graf ..... 318/580
6,624,537 B2 * 9/2003 Westlake ..... 307/125
6,655,640 B2 * 12/2003 Wolf et al. ..... 246/167 R
6,696,805 B2 * 2/2004 Tanner et al. ..... 318/280
2005/0225425 A1 * 10/2005 Zahornacky ..... 340/2.4

* cited by examiner

*Primary Examiner*—Michael J Sherry
*Assistant Examiner*—Hal I Kaplan
(74) *Attorney, Agent, or Firm*—O'Melveny & Myers LLP

(57) ABSTRACT

A variable-range power supply for a model vehicle layout, such as a model train track for powering model trains or the like, is configured to receive a control input defining respective ends of an output voltage range. The control input may correspond to opposing ends of a range of motion for a hand-operated actuator, or other control input. The power supply further includes a controller configured to allow a user to select a desired output voltage level for a minimum or maximum of the output range. Output power is maintained within the user-specified range.

10 Claims, 3 Drawing Sheets

36

| Minimum Set Point (42) | Maximum Set Point (44) |
|---|---|
| 6V | 18V |
| 6V | 15V |
| 9V | 15V |
| ⋮ | ⋮ |
| 0V | 12V |

$48_1$, $48_2$

POWER SUPPLY FOR MODEL VEHICLE

BACKGROUND OF THE INVENTION

1. Field of the Invention

The present invention relates to model vehicle systems, for example, model trains and accessories. More particularly, the invention relates to a power supply for a model vehicle system.

2. Description of Related Art

Model trains and accessories have been generally known for decades. In many model railway systems, model trains and accessories receive electrical power from a voltage that is applied to the tracks. A power supply is used to apply the voltage to the tracks, while contacts on the bottom of the train, or metallic wheels of the train, pick up the applied voltage for motors and other electrical components. The power supply may be used to control both the amplitude and polarity of the voltage, thereby controlling the speed and direction of the train. In HO systems, the voltage is typically a DC voltage. In O-gauge systems, the track voltage is typically an AC voltage transformed by a transformer in the power supply from a higher household voltage (e.g., 120 or 240 volts AC), to a reduced AC voltage (e.g., 0-18 volts AC).

Speed control for model vehicles on a model track may be accomplished by controlling the voltage supplied to the track. For example, in a typical O-gauge system operated in a conventional control mode, the speed may be controlled by adjusting a handle, lever, knob or other input adjuster on a power supply module, also called a power controller. The position of the input adjuster controls the magnitude of voltage supplied to the layout, via circuitry in the power controller. The higher the magnitude of the voltage applied to the system, the faster the train will travel, and vice versa. In known power supplies, the voltage adjuster for the power controller has a first position corresponding to zero volts or "OFF", and a second position corresponding to a maximum voltage (e.g., 18-25 volts), or fully "ON". The power controller is configured such that the voltage level is adjusted throughout the range of motion of the input adjuster, from zero to the maximum voltage. A user may thereby adjust the voltage supplied to the train system and the speed of the train by moving the adjuster, such as a lever or a knob, in either a first or second direction.

Notwithstanding their advantages, power controllers as known in the art are subject to certain limitations. For instance, in some O-gauge systems the electric motor is of the type that requires approximately six to nine volts to overcome starting resistance and begin moving. For example, for power supplies having an output range of zero to 18 volts, a voltage control adjuster needs to be moved roughly 40-50% of its available range of movement just to begin movement of the train. Consequently, only 50-60% of the available range of movement remains for the control of the speed. This reduced range of movement may result in reduced precision, resolution and overall control. An additional disadvantage related to this reduced range of movement is that long-time model railroad hobbyists have grown accustomed to using the entire range of movement path for speed control. Accordingly, known systems having a reduced useful range of movement may be a source of dissatisfaction for experienced hobbyists.

Accordingly, a need exists for a power controller for a model vehicle system that minimizes or eliminates one or more of the above-identified deficiencies.

SUMMARY OF THE INVENTION

The invention provides a power controller for supplying electrical power to a model vehicle layout and to motorized vehicles thereon, that overcomes the limitations of the prior art. A power controller in accordance with the present invention includes an adjuster having first and second opposing positions defining respective ends of an output voltage level range on an output of the power supply. The power controller further includes a control circuit configured to allow a user to select a desired output voltage level for a set point. The set point substantially corresponds to one of the first and second positions of the adjuster, and at least partly defines an operating output range of the power controller. For example, a set point corresponding to a first adjuster position may correspond to an apparent output range minimum, such as to six volts, for a controller providing power in the range of zero to 18 volts. The control circuit may further be configured to provide output power in an adjusted range between the apparent minimum as defined by the adjustable set point, and a maximum voltage. For example, this range may be defined as between six and 18 volts. The control circuit may comprise any suitable electronic components, for example, a programmable processor, for receiving user input, adjusting a set point, and controlling power over an adjusted output range.

The power controller thereby permits a user to make use of any desired amount of the range of movement of a control adjuster, and eliminate dead zones associated with some prior-art power controllers, such as with prior-art O-gauge speed control systems.

A more complete understanding of the power controller will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The invention provides a power controller with an adjustable output range for a model vehicle system, that overcomes the limitations of the prior art. Using the power controller, a hobbyist may select a range of output power associated with a given amount of movement of an input actuator. In the detailed description that follows, like element numerals are used to indicate like elements appearing in one or more of the figures.

Figure 1:
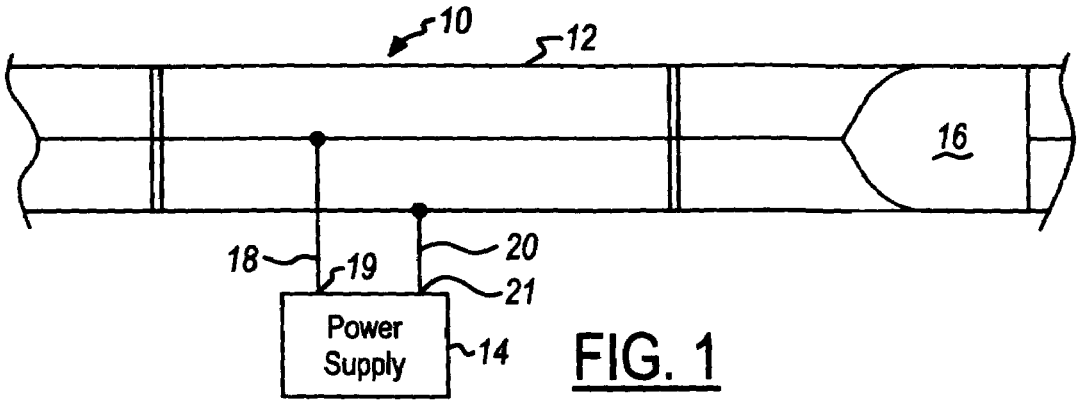
FIG. 1 is a schematic diagram showing of a model vehicle system in accordance with the present invention.

FIG. 1 shows a first exemplary embodiment of a model vehicle system, such as a model railroad system 10. The model vehicle system illustrated in the drawings and described below is that of a model railroad. However, the invention is not limited to such model railroad systems, and may be used in connection with other model vehicle systems in which power is supplied from a power controller to model vehicles and accessories over an adjustable range.

In an exemplary embodiment, model train system 10 includes a track 12, a power supply controller 14, and a train 16. In an exemplary embodiment, track 12 is a three rail track. Power controller 14 provides power to track 12 by way of connectors 18 and 20. In the illustrated embodiment, the power terminal 19 of power controller 14 is connected to the center or third rail of track 12 via connector 18 and the neutral terminal 21 is connected to at least one of the two outer rails of track 12 via connector 20. The power and neutral terminals 19, 21 collectively define a power output of power controller 14. Train 16 may be configured with rolling or sliding contacts connecting the train to the power and neutral rails of track 12. For example, electrically conductive metallic wheels may be configured to pick up the power applied to track 12 and supply it to an electric motor (not shown) of train 16.

Figure 2A:
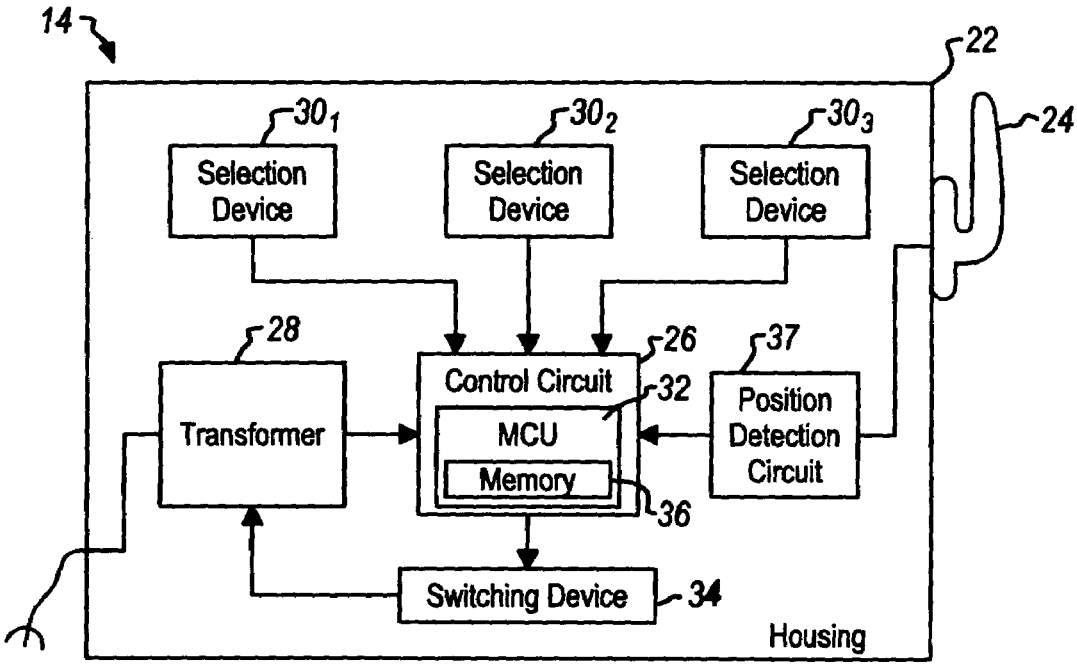
FIG. 2A is a block diagram showing a power controller in accordance with the present invention.
Figure 2B:
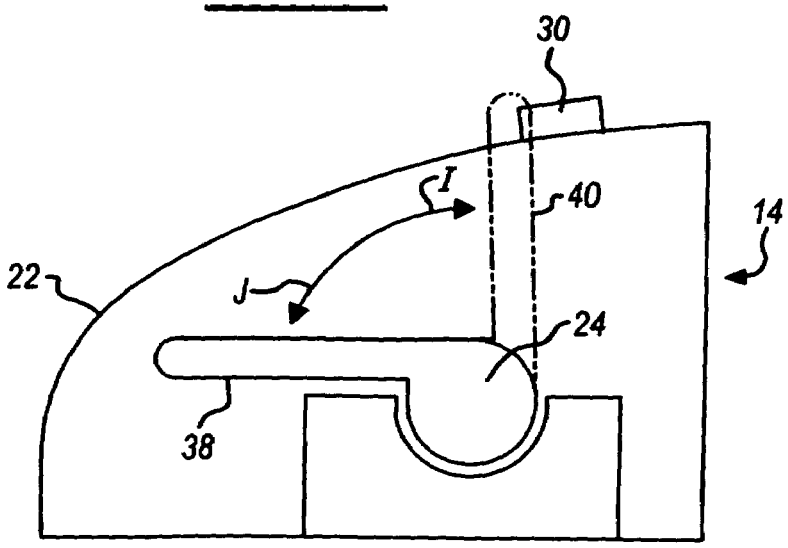
FIG. 2B is a side elevation view of an exemplary power controller with a moveable voltage adjuster in accordance with the present invention.

With reference to FIGS. 2A and 2B, an exemplary embodiment of power supply controller 14 is shown. Power controller 14 includes, generally, a housing 22, an adjuster 24, a control circuit 26, a transformer 28, and a plurality of selection devices 30. Adjuster 24 may comprise a hand-actuated lever, handle or the like rotatably mounted on housing 22. A position detection circuit 37 is operative sense the adjuster position and provides a position signal to control circuit 26, which causes a desired amount of voltage corresponding to the adjuster position to be supplied to track 12. Thus, the adjuster may be used to vary the speed at which train 16 travels by rotating adjuster 24 in either of the 'I' and 'J' directions shown in FIG. 2B. Instead of or in addition to a rotating adjuster, a sliding adjuster (not shown) may be used for voltage and speed control.

In the illustrated embodiment, housing 22 is configured to contain control circuit 26 and transformer 28. In another embodiment, transformer 28 may be external to housing 22. Housing 22 may be further configured to have any desired number of selection devices $\mathbf{30}_1$-$\mathbf{30}_3$ mounted thereon, such as keys, buttons, switches or any suitable user input device. The selection devices may be configured to activate various operating features of the train, such as a horn, bell, whistle, smoke, lights, and so forth. In addition, one or more selection devices may be configured for selection of a set point defining a range of operation for an output voltage, as described below.

Figures 3, 4:
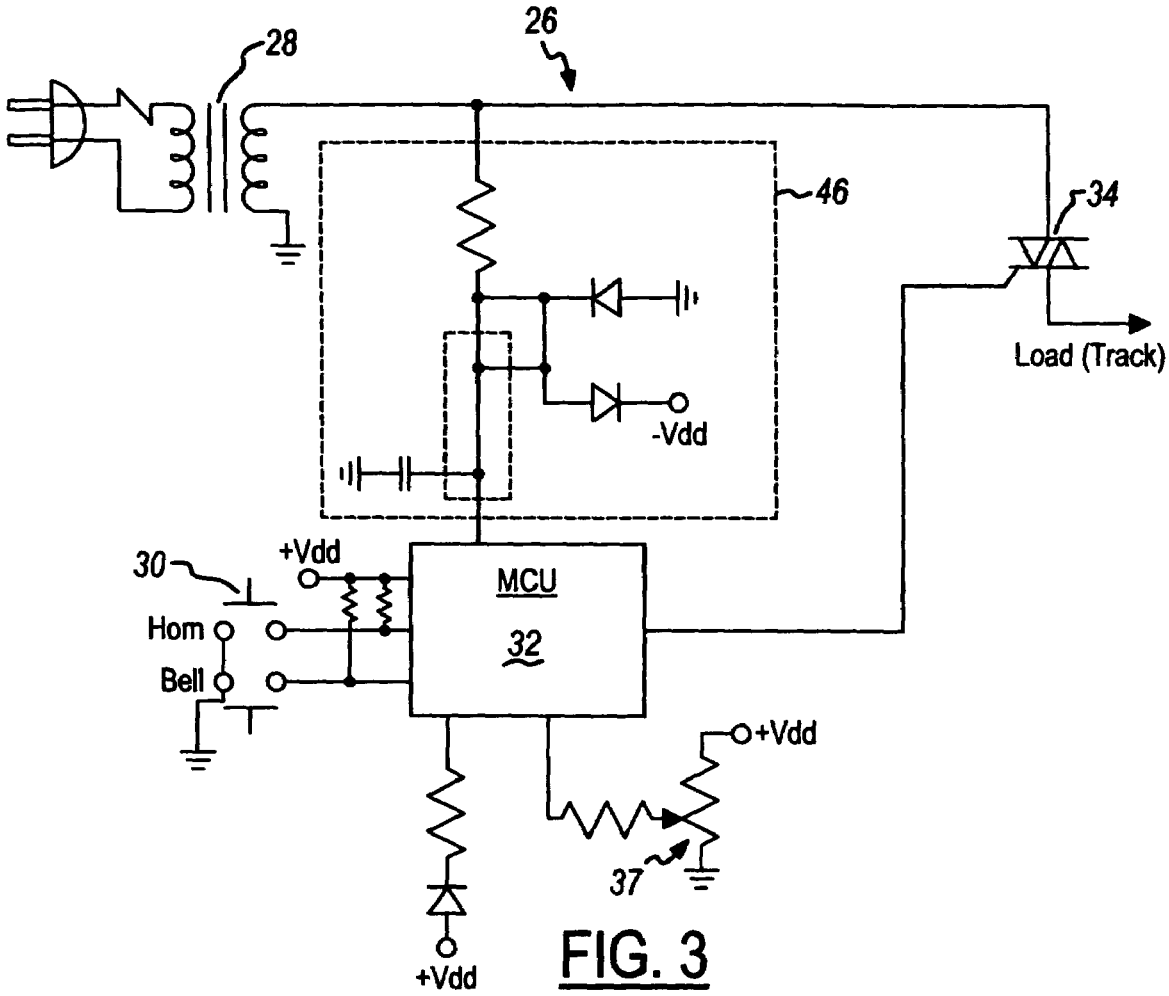
FIG. 3 is a circuit diagram showing an exemplary control circuit for a power controller in accordance with the present invention.
FIG. 4 is a chart showing aspects of a control program for a power controller in accordance with the present invention.

FIGS. 2A and 3 show an exemplary control circuit 26 for use in an embodiment of a power controller according to the invention. Control circuit 26 may include a controller 32 and a switching device 34 controlled by controller 32. Switch 34 may be connected between a source of power (i.e., transformer 28) and track 12. In an exemplary embodiment, switching device 34 comprises a voltage regulator such as a triac. Controller 32 may comprise a standard microcontroller unit (MCU) configured to perform programmed arithmetic and logic functions, as well as to receive inputs and generate outputs, and also includes a memory 36. Any other suitable analog or digital control circuitry and switching devices may also be suitable for use in the power supply of the present invention. For instance, a microprocessor unit (MPU) with peripheral memory chips may be used in place of the MCU 32. Likewise, other voltage regulators, including MOSFETS or other switching devices having like characteristics and functionality, may be used in place of triac 34.

As shown in FIGS. 2A and 3, control circuit 26 and MCU 32 may be connected to secondary of transformer 28. Transformer 28 may comprise a conventional AC or DC transformer, depending on the requirements of railroad layout 10, and in particular, model train 16. Additionally, transformer 28 may provide a fixed output, a variable output, or both. In an exemplary embodiment, railroad layout 10 comprises an O-gauge layout and transformer 28 an AC transformer which transforms household AC line voltage (e.g., 120 or 240 volts AC) to a reduced level (e.g., 0-18 volts AC). As will be discussed in greater detail below, MCU 32 is configured to control the amount of voltage supplied to track 12 by transformer 28.

MCU 32 may also be electrically connected to a position detection circuit 37. The position detection circuit may comprise any suitable sensor, such as, for example, a potentiometer. The detection circuit may be coupled to adjuster 24 and configured to provide position information to MCU 32. Adjuster 24, which may take the form of a conventional handle or dial, is configured for movement in 'I' and 'J' directions between a first position 38 and a second position 40 (best shown in FIG. 2*b*), wherein first position 38 and second position 40 are opposing positions that define respective ends of an output voltage range of power controller 14. Adjuster 24 may take other forms (i.e., slider or pushbuttons), and thus, those forms discussed in detail above are provided for exemplary purposes only and are not limiting in nature. In known power supplies, first position 38 corresponds to an output of zero volts or "OFF", while second position 40 corresponds to a maximum voltage output (i.e., 18 volts) or fully "ON".

Potentiometer 37 is responsive to the movement of adjuster 24 in both I and J directions. In response to the changes in impedance of potentiometer 37, MCU 32, depending on the particular implementation, performs additional calculations. In the illustrated embodiment, using triac 34 as a voltage regulator device, MCU 32 calculates a phase conduction angle for triac 34. MCU 32 may be connected to the gate terminal of triac 34 so as to provide a conduction signal corresponding to the conduction angle to the gate terminal of triac 34. Triac 34 may be connected between a power source (e.g., transformer 28) and track 12, and the phase conduction angle may represent a total angle over which the flow of current occurs through triac 34 to track 12. Therefore, the power supplied to track 12 from transformer 28 is regulated by triac 34 under the control of MCU 32. Accordingly, in operation, as adjuster 24 is moved in the 'I' direction, the conduction angle of triac 34 may increase, thereby increasing the power supplied to the track 12. Conversely, as adjuster 24 is moved in the 'J' direction, the conduction angle of triac 34 may be decreased, thereby decreasing the power supplied to track 12. It should be noted that for a power controller having numerous outputs, a corresponding triac may be provided for each output. In this arrangement, the operation and functionality of each triac may be the same as that discussed above. Additionally, as shown in FIG. 3, control circuit 26 may also include a zero cross detector 46 that is electrically connected between the secondary winding side of transformer 28 and MCU 32.

In addition to the functionality described above, MCU 32 may also be configured to have first and/or second set points 42, 44 that can be programmed to correspond to desired output voltage levels, as shown in FIG. 4. As described in the Background, known arrangements are not often optimal because in many systems, a train or other vehicle requires, for example, six to nine volts to begin moving. For a power supply having a maximum output of 18 volts, starting resistance results in a 40-50% reduction in the range of movement that can be used to control the speed of the train once it begins moving. Accordingly, adjuster 24 and MCU 32 can be used to establish, among other things, one or both of set points 42, 44 to allow for improved sweep control of the train speed, among other things.

In one embodiment, set point 42, which corresponds to an adjuster position at or near first position 38, can be programmed such that it substantially corresponds to the minimum voltage required to impart movement onto train 16, which, in an exemplary embodiment, is a voltage in between six and nine volts. In an exemplary embodiment, set point 42 corresponds to an adjuster position that is slightly forward from first position 38 in the I direction so that first position 38 still corresponds to zero volts or "OFF", thereby maintaining an "OFF" adjuster position. Programming set point 42 allows a user to utilize the entire range of movement of adjuster 24 to control the speed of train 16, thereby increasing the precision, resolution and overall control of the train speed.

In another embodiment, both set point 42 and set point 44 can be programmed. In this embodiment, set point 42 can be programmed, for example, to correspond to the minimum voltage required to impart movement onto train 16 (i.e., six to nine volts), while set point 44, which corresponds to an adjuster position at or near second position 40, can be set to correspond to either the maximum voltage that can be supplied to train 16 (i.e., 18 volts) or to a voltage level that is less than the maximum voltage level. This arrangement will allow a user to utilize an increased amount of, and perhaps substantially the entire range of movement of, adjuster 24 to control the speed of train 16 between minimum and maximum voltage levels, or between two predetermined voltage levels; and the smaller the gap between the two set points 42, 44, the greater level of precision, resolution and overall control of train 16.

In an exemplary embodiment, power controller 14, and MCU 32 in particular, has a programming state of operation and a supply state of operation. In the programming state, either one or both of set points 42, 44 can be programmed to predetermined levels. In the supply state, power controller 14 supplies power to track 12 and the supplied power can be adjusted using adjuster 24. A selection device mounted to housing 22 of power controller 14, such as one or more of pushbuttons 30 (i.e., 301), can be used to select either the programming state or supply state. However, in an alternate embodiment, each of the programming and supply states may be activated or deactivated using separate dedicated pushbuttons wherein each pushbutton corresponds to a respective state of operation. Accordingly, MCU 32 is configured to monitor the state of each pushbutton 30 and to go into the programming state when the programming state of operation is selected, and to go into the supply state when the supply state of operation is selected. It should be noted that while pushbuttons were discussed in detail above, other types of selection devices, such as toggle switches for example, can be used to carry out the same functionality. Additionally, power controller 14, and MCU 32 in particular, can be configured such that various routines, combinations and/or sequences of actions, such as depressing a compliment of pushbuttons, can be used to change from one state to the other.

Once in the programming mode, either one or both of set points 42, 44 can be programmed. In one embodiment, MCU 32 is configured to monitor pushbuttons 30 (i.e., the pushbuttons corresponding to a bell and whistle operating feature, for example), and to recognize when certain predetermined sequences, combinations and/or routines that correspond to the programming of either or both of set points 42, 44, respectively, are performed by a user.

For example, in one embodiment, when MCU 32 is in the programming state, it will detect that the pushbuttons 30 corresponding to the bell and whistle, for example, have been simultaneously depressed and remain depressed. This indicates to MCU 32 that set point 42 is to be programmed. MCU 32 then monitors the movement of adjuster 24 in the I-direction, and the corresponding adjustment of potentiometer 37 more particularly. Once the desired voltage level is reached, MCU 32 will detect that the pushbutton corresponding to the bell feature has been released or deselected. MCU 32 will then store the potentiometer setting and corresponding voltage level in memory 36. MCU 32 will then detect whether only set point 42 is to be programmed or whether set point 44 is also to be programmed. In an exemplary embodiment, if the user only wishes to program set point 42, MCU 32 will detect that adjuster 24 is moved back to position 38. After a predetermined amount of time lapses (i.e., five seconds), MCU 32 will recognize that only set point 42 is to be programmed and will associate the stored output voltage with set point 42. MCU 32 is also configured to program only set point 44 in a similar manner except that instead of releasing the bell pushbutton, the whistle pushbutton is released while the bell pushbutton remains depressed. This causes MCU 32 to associate the desired output voltage level with set point 44.

On the other hand, if it is desired to program both set point 42 and set point 44, MCU 32 will detect, in an exemplary embodiment, that the whistle pushbutton remains depressed and that adjuster 24 is moving to a new voltage level. MCU 32 will then detect that the desired voltage level is reached when the whistle pushbutton is released. MCU 32 will then record and store that potentiometer setting and corresponding output voltage in memory 36. MCU 32 will sense when the programming is complete by monitoring the position of adjuster 24. When adjuster 24 reaches first position 38, and after a predetermined amount of time lapses (i.e., 5 seconds), MCU 32 will associate the first stored output voltage with set point 42 and the second stored output voltage with set point 44. Accordingly, when put into supply mode, MCU 32 will supply voltage ranging between set point 42 and set point 44.

In one embodiment, MCU 32 will retain the stored values until power controller 14 is turned off. In an alternate embodiment, MCU 32 will retain the stored values until MCU 32 is reprogrammed, regardless of whether power controller 14 is turned off.

It should be noted that while only the sequences or routines above were described in great detail, MCU 32 can be configured such that other sequences or routines can be employed to carry out the programming function. Accordingly, the sequences or routines set forth above were provided for exemplary purposes only and are not limiting in nature.

A further aspect of the present invention is that power controller 14, and MCU 32 in particular, can be reprogrammed and/or the programmed set points can be cleared or erased. In such an instance, one or both of the previously stored output voltage levels corresponding to set points 42, 44, respectively, can be replaced with subsequent desired voltage levels, or all programmed values can be removed altogether. Accordingly, power controller 14 is not limited to a one-time programming, but rather can be programmed and reprogrammed as the user wishes. As with the programming of power controller 14, the clearing of stored programmed values or the reprogramming of set points 42, 44 can be performed using a number of different routines or sequences. In one exemplary routine, MCU 32 will sense that adjuster 24 has been moved to first or "OFF" position 38, and that pushbuttons 30 corresponding to the bell and whistle features are depressed. Once a predetermined amount of time elapses (i.e., five seconds), MCU 32 will recognize that the stored values are to be purged or otherwise erased. Accordingly, all stored values will be cleared, thereby allowing for the known operation of power controller 14, or allowing for the reprogramming of power controller 14.

With reference to FIG. 4, an additional feature of power controller 14 is that it may be configured to store a predetermined number of programmed settings 48 in memory 37 wherein each setting corresponds to a pair of programmed output voltage levels for set points 42, 44, respectively. For example, in one setting designated as setting $\mathbf{48}_1$ in FIG. 4, set point 42 is programmed to correspond to six volts, while set point 44 is programmed to correspond to 18 volts. In a second setting designated as setting $\mathbf{48}_2$, set point 42 is programmed to correspond to six volts and set point 44 is programmed to correspond to 15 volts. In an embodiment having this feature, MCU 32 may be configured to sense which stored setting 48, (where i=1 to n), has been selected. A selection device, such as a dial (not shown), having a number of positions that correspond to the number of possible stored settings 48 may be provided to allow a user to make a selection. Alternatively, in other embodiments, a series of selection devices such as pushbuttons 30 wherein each pushbutton corresponds to a respective setting 48, a conventional keyboard or any number of other user input methods known in the art can be used to carry out the same functionality.

With reference to FIG. 2*a*, in an exemplary embodiment, power controller 14 can operate in either a known mode of operation or the programmed mode of operation discussed above. In the known mode, first and second positions 38, 40 of adjuster 24 correspond to zero volts and a predetermined maximum voltage (i.e., 18 volts), respectively, and adjuster 24 is used to increase or decrease the voltage between these two levels. In such an embodiment, power controller 14 includes a mode selection device, such as pushbutton $\mathbf{30}_2$, that can change the mode of operation between the known mode and the programmed mode. This configuration may allow users to switch back and forth between modes of operation, or to customize power controller 14 such that one user can operate in the known mode, and another user can operate in the programmed mode. As with the state selection device discussed above, the mode selection device of the present invention is not limited to a pushbutton. Other selection devices and selection means exist, such as, for example, toggle switching devices, etc., that remain within the spirit and scope of the present invention.

In yet another embodiment, power controller 14 may include more than one output to supply power to a corresponding number of devices or loads. In this configuration, MCU 32 can be configured such that either one or any number of the outputs can be programmed as discussed above. In an embodiment wherein more than one output can be programmed, power controller 14 may include a pair of adjusters 24 (not shown), and/or an output selection device to select which output the user would like to program. As with the selection devices discussed above, the output selection device may take the form of a pushbutton 303, for example, or any number of selection devices known in the art. In this embodiment, the selected output is programmed following the same or equivalent routine discussed above. MCU 32 may be further configured such that both outputs can be programmed, using the same or equivalent routine set forth above and the respective set points 42, 44 can be stored in the memory 37 of MCU 32.

Figure 5:
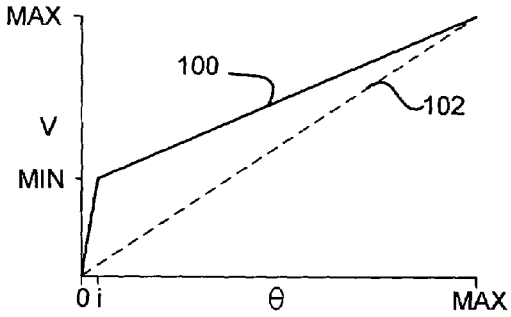
FIG. 5 is a chart showing an exemplary output profile for a power controller.

FIG. 5 shows an exemplary output profile 100 for a power controller according to the invention. The output profile may be adjusted over an operating range of output power, such as between zero volts and a maximum voltage ("MAX"), shown on the vertical scale. The power controller may comprise an adjuster, such as a pivoting lever or slide. The horizontal scale may indicate, for example, an angular position ("θ") of a rotating lever. The chart indicates that the adjuster is moveable between a zero or home position and a fully-on or maximum ("MAX") position. Each position on the horizontal scale corresponds to an output voltage on the vertical scale, thereby defining a profile.

Dotted line 102 illustrates a prior-art linear fixed output profile. Only that portion of the profile that is greater than a certain minimum voltage ("MIN"), e.g., 6 volts, is useful for controlling a model vehicle. Below the minimum voltage, a model vehicle supplied with the output voltage will not move. Thus, when output profile 102 is used by a power controller, a substantial portion of the range of motion of the adjuster is used up in bringing the output voltage up to the minimum voltage, and less adjuster movement is available for control of train speed.

Therefore, the output profile may be adjusted to a more useful profile 100, based on one or more user inputs. For example, a user input may comprise a value defining the minimum useful voltage MIN for the output profile. After receiving such an input, a pretermined or user-defined initial adjuster position "i" may be correlated to the minimum voltage. The remainder of the available adjuster movement between θ "i" and θ MAX may be correlated, e.g. via a linear relationship, to a voltage range between V MIN and V MAX. When the adjuster is moved from the zero or home position to the θ "i" position, the output voltage may be increased from zero to V MIN. This permits the adjuster to be used to switch output power on and off, as well as to control output voltage over the useful range. A power controller may be configured to vary the output profile based on changes in a user input V MIN or V MAX, as previously described.

Figure 6:
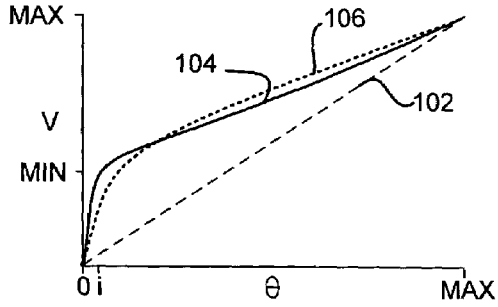
FIG. 6 is a chart showing alternative exemplary output profiles for a power controller.

FIG. 6 illustrates alternative non-linear output profiles 104, 106 that may also be useful for controlling a model vehicle. Although the invention is not limited to a specific output profile, the benefits of a linear profile 100 as shown in FIG. 100 may be realized using a suitable non-linear profile 106, 104. Profile 104 closely approximates profile 100, while profile 106 approximates profile 100 less closely. One of ordinary skill in the art may configure a controller to provide a non-linear output profile that approximates a linear profile useful for controlling a model vehicle. Non-linear profiles such as profiles 104, 106 may also be correlated to adjuster position based on user input, such as on values of V MIN or V MAX.

Figure 7:
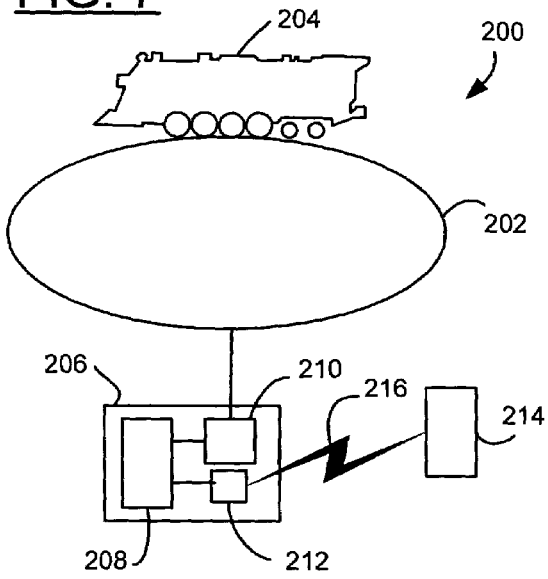
FIG. 7 is a block diagram showing an exemplary model vehicle system using a wireless module for power control.

In an embodiment of the invention, a power supply for a model vehicle may receive user input via a wireless interface. FIG. 7 shows one such exemplary system 200. System 200 comprises a track 202 for supplying power to a model vehicle 204. Track 202 may comprise a two or three-rail track connected to a power supply 206. Power supply 206 may comprise a controller 208, such as any suitable programmable logic controller, operably associated with a power control module 210 for controlling an amount of power supplied to layout 202. Power supply 206 may also comprise a receiver 212 for providing a communication link 216 to a remote user interface unit 214. The remote unit may comprise a circuit for receiving user input via an adjuster, keypad, touchscreen, or other interface device, and providing a signal through a suitable communication link to controller 208. Controller 208 then controls power modulating circuit 210 to provide the commanded amount of power in an output profile determined from user input.

Figure 8:
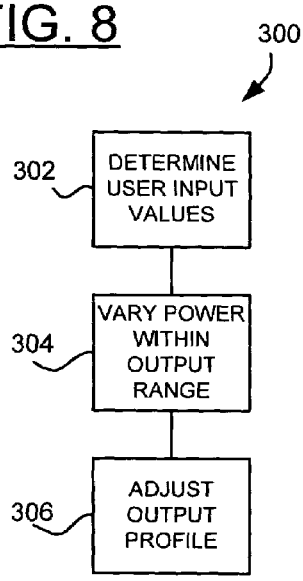
FIG. 8 is a flow chart showing exemplary steps for performing a method according to the invention.

According to the foregoing, therefore, the invention provides a method 300 for controlling power supplied to a model vehicle within a variable output range, exemplary steps of which are shown in FIG. 8. The indicated steps may be performed in any operative order. At step 302, one or more user input values defining an output profile over an operating range are determined. For example, input may be received using a voltage adjuster, keypad, or touchscreen. A first user input may indicate a desired current output as a percentage of a range between an minimum and a maximum voltage. For example, a first user input may indicate that 50% of useful power is desired. Useful power, in turn, may be defined by a second user input, such as an input indicating a desired minimum voltage for a useful power range. For example, in a 0-18 V power supply, a useful range may comprise 6-18 V with a user input specifying 6 V as the minimum useful power. A value of the second user input may be determined from a position of an adjuster when a reset signal is received from a user input.

At step 304, an amount of power supplied to a model vehicle within an output operating range is varied in response to the first user input. For example, if an output profile has a minimum voltage of 6V and a maximum voltage of 18V, a first user input indicating 50% power causes a 12V output. The output may be increased or decreased per the desired profile in response to changes in user input.

At step 306, the output profile may be adjusted to define a desired slope or curve between two or more set points. For example, a minimum power level of an output operating range may be set to a value defined by a second user input, with the output profile defined linearly between the defined minimum and a predetermined maximum. Likewise, a maximum power level of the output operating range may be adjusted to a value defined by a third user input. In the alternative, or in addition, more than two set points may be used. An output profile between defined set points may be defined by any desired linear or non-linear relationship correlating an adjuster position to an output voltage. Some examples are provided above in connection with FIGS. 5 and 6.

Having thus described a preferred embodiment of a power supply for a model vehicle, it should be apparent to those skilled in the art that certain advantages of the within system have been achieved. It should also be appreciated that various modifications, adaptations, and alternative embodiments thereof may be made within the scope and spirit of the present invention. For example, a variable output range power controller for a model vehicle has been illustrated, but it should be apparent that the inventive concepts described above would be equally applicable to power controllers for other applications. The invention is defined by the following claims.

What is claimed is:

1. An apparatus for controlling power supplied to a model vehicle, the apparatus comprising:

a power control circuit adapted to vary an amount of power supplied to a model vehicle within an output operating range in response to a first user input, and to define an output profile over the output operating range using a second user input, wherein the power control circuit is adapted to connect to a model track for the model vehicle;

an adjuster moveable between first and second stop positions, the power control circuit determining a value of the first user input from the position of the adjuster, and varying the amount of power supplied to the model vehicle within the operating range corresponding to a range of movement of the adjuster;

wherein the power control circuit is adapted to determine a value of the second user input from a position of the adjuster when a reset signal is received from a user input.

2. The apparatus of claim 1, wherein the power control circuit comprises a programmable logic controller.

3. The apparatus of claim 1, wherein the power control circuit is further adapted to define the output profile over the output operating range using a third user input.

4. An apparatus for controlling power supplied to a model vehicle, the apparatus comprising:

circuit means for varying an amount of power supplied to a model vehicle within an output operating range in response to a first user input, and for defining an output profile over the output operating range using a second user input;

user input means for moving between first and second stop positions, wherein the circuit means determines a value of the first user input from the position of the user input means, and varies the amount of power supplied to the model vehicle within the operating range corresponding to a range of movement of the user input means;

wherein the circuit means is adapted to determine a value of the second user input from a position of the user input means when a reset signal is received.

5. A method for controlling power supplied to a model vehicle, the method comprising:

varying an amount of power supplied to a model vehicle within an output operating range in response to a first user input;

adjusting an output profile within the output operating range using a second user input; and determining a value of the second user input from a position of an adjuster when a reset signal is received from a user input.

6. The method of claim 5, further comprising adjusting the output profile within the output operating range using a third user input.

7. An apparatus for controlling power supplied to a model vehicle, the apparatus comprising:

an adjuster selectively moveable between first and second stop positions; and a power control circuit operatively coupled to the adjuster, the power control circuit having a first mode in which the first and second stop positions correspond to respective minimum and maximum output voltages that can be supplied to the model vehicle, and a second mode in which at least one of the first stop position and the second stop position is programmable to correspond to an output voltage value between the minimum and maximum output voltages;

wherein a range of motion of the adjuster as between the first and second stop positions provides a first output voltage range while in the first mode and a second output voltage range while in the second mode, the second output voltage range being a subset of the first voltage range.

8. The apparatus of claim 7, wherein in the second mode the first stop position is programmable to correspond to a first programmable output voltage value higher than the minimum output voltage.

9. The apparatus of claim 8, wherein the first programmable output voltage value corresponds to a voltage sufficient to cause the model vehicle to begin moving.

10. The apparatus of claim 7, wherein in the second mode the second stop position is programmable to correspond to a second programmable output voltage value lower than the maximum output voltage.

* * * * *